United States Patent [19]

Bogner

[11] Patent Number: 4,902,031

[45] Date of Patent: Feb. 20, 1990

[54] TOE UNIT OF A SAFETY SKI BINDING

[75] Inventor: Martin Bogner, Ostfildern, Fed. Rep. of Germany

[73] Assignee: Geze Sport International GmbH, Leonberg, Fed. Rep. of Germany

[21] Appl. No.: 250,455

[22] Filed: Sep. 28, 1988

[30] Foreign Application Priority Data

Oct. 12, 1987 [DE] Fed. Rep. of Germany ..... 3734492

[51] Int. Cl.[4] ..... A63C 9/08

[52] U.S. Cl. ..... 280/625; 280/628; 280/634; 280/636

[58] Field of Search ..... 280/625, 626, 628, 629, 280/634, 636

[56] References Cited

U.S. PATENT DOCUMENTS

| | | | |
|---|---|---|---|
| 3,920,256 | 11/1975 | Sittmann | 280/625 |
| 4,062,563 | 12/1972 | Manfreda | 280/629 X |
| 4,298,213 | 11/1981 | Storandt | 280/628 |
| 4,337,965 | 7/1982 | Salomon | 280/628 |
| 4,478,426 | 10/1984 | Scheck | 280/625 |
| 4,735,434 | 4/1988 | Sedlmair | 280/625 |

FOREIGN PATENT DOCUMENTS

| | | | |
|---|---|---|---|
| 2364298 | 6/1975 | Fed. Rep. of Germany | 280/628 |

*Primary Examiner*—Charles A. Marmor
*Assistant Examiner*—Brian L. Johnson
*Attorney, Agent, or Firm*—Townsend and Townsend

[57] ABSTRACT

A safety ski binding has a toe unit arranged in front of a front foot plate (21) and a heel unit which exerts a forwardly directed thrust force on the toe unit via the inserted ski boot. The toe unit has a sole clamp (16) which supports the front part of the sole (14) of the ski boot (15) from the front, sideways and from above and is pivotable against a substantially forwardly directed spring force about a respective one of two substantially vertical axes of rotation (17) provided on both sides of the vertical central longitudinal plane (11). An abutment (18) which faces downwardly and forwardly is provided on the sole clamp (16) at the region between the axes of rotation (17) and cooperates with an inclined surface (19) which is fixed relative to the housing and which extends downwardly and rearwardly from the top. The cooperation between abutment (18) and surface (19) is such that when the ski boot (15) is inserted its sole (14) holds the sole clamp (16) against the downwardly directed spring bias at a level at which the abutment (18) is located at at least a small distance from the inclined surface (19). The ski boot (15) is downwardly yieldingly supported on the ski (22) whereby a downwardly directed counterforce to the sole clamp resetting force is generated during a forward fall in dependence on the inclination of the inclined surface (19) and on the resilient bias of the sole clamp (16).

14 Claims, 2 Drawing Sheets

TOE UNIT OF A SAFETY SKI BINDING

BACKGROUND OF THE INVENTION

The invention relates to a safety ski binding arranged in front of a front footplate of a ski, with the heel unit of the safety ski binding preferably exerting a forwardly directed thrust force on the toe unit via the inserted ski boot.

In an arrangement of this kind proposed in the German laying open print DE-OS 37 20 440 the toe unit comprises a sole clamp which supports the front part of the sole of the ski boot from the front, sideways and from above and which is pivotable against a substantially forwardly directed spring force about one of two substantially vertical axes of rotation disposed on both sides of the vertical central longitudinal plane of the binding. In this way, on the occurrence of predetermined lateral forces at the front part of the sole of the ski boot, the sole clamp can pivot outwardly about the axis of rotation lying in the direction of the lateral force and release the ski boot. In the earlier arrangement the sole clamp is displaceable relative to the housing in the direction of the axes of rotation and is resiliently biased in this direction towards the front part of the sole of the ski boot.

More specifically the vertically displaceable sole clamp is acted on from below by a double-armed lever on which an upwardly directed force is exerted via a rod and wedge transmission from the footplate which is pressed downwardly by the sole of the ski boot in order to reduce the lateral force required for lateral release of the toe unit in the event of a forward fall of the skier. The disadvantage of this known toe unit is the fact that a motion and force transmitting device has to be arranged between the vertically movably arranged footplate for the front part of the sole of the ski boot and the vertically displaceable sole clamp.

SUMMARY OF THE INVENTION

The object underlying the present invention is to provide a toe unit of the initially named kind, with which, in the event of forward inclination and in particular of a forward fall of the skier, the sideways release force is reduced in defined manner without a force transmitting device having to be arranged between the footplate and the sole clamp.

This object is satisfied by a toe unit which is characterized in that a downwardly and forwardly facing abutment is provided in the region between the axes of rotation, and preferably in the middle between the axes of rotation, on the sole clamp or on a part movable with it along the axes of rotation, and cooperates with an inclined surface fixed relative to the housing and extending from the top downwardly and rearwardly in such a way that when the ski boot is inserted its sole holds the sole clamp against the downwardly directed spring bias at a level at which the abutment is located at at least a small distance from the inclined surface and in any event exerts no forces on the inclined surface; and in that the ski boot is downwardly yieldingly supported on the ski in such a way that with forward inclination of the skier, e.g. in the event of a frontal fall, the parts of the sole which engage with the sole clamp more downwardly so far that the abutment on the sole clamp, which follows the movement of the sole, abuts on the inclined surface at least during a simultaneous sideways release movement of the sole clamp, and thereby generates a counterforce to the sole clamp resetting force generated by the substantially forwardly directed spring force with the counterforce being dependent on the inclination of the inclined surface and the resilient bias of the sole clamp in the downward direction, and being smaller than the sole clamp resetting force.

A particularly preferred further development of the invention is characterized in that, in manner known per se, the sole clamp has two linear and substantially vertically extending tilting surfaces provided on both sides of the vertical central longitudinal plane which are pressed by a substantially forwardly directed spring force against support surfaces provided on the housing parallel to the tilting surfaces on both sides of the vertical central longitudinal plane whereby two tilting axes forming the axes of rotation are formed for the sole clamp.

The concept underlying the invention is accordingly to be seen in the fact that the tip of the sole which is in engagement with the sole clamp is made capable of undergoing a defined movement downwardly during forward inclination of the skier, in particular during a forward fall, until a force acting downwardly on the sole clamp and generated by a spring or by the sole of the ski boot itself presses the abutment against the inclined surface whereby a releasing force is exerted on the sole clamp in the sense such that the lateral release can be brought about with a smaller force. The greater the downward movement of the tip of the sole, i.e. the more intensive the pressure which is exerted from above downwardly onto the front part of the sole of the ski boot the longer or further the abutment is able to move on the inclined surface, i.e. the reduction of the lateral release force is maintained during lateral release, over a greater pivoting angle of the sole clamp. Thus, in accordance with the invention, the counterforce to the sole clamp resetting force becomes effective from a specific downward movement of the sole onwards and has a constant value. The more the tip of the sole is pressed downwardly the longer this counterforce is maintained during sideways release.

The downward movement of the sole of the ski boot during a forward fall is ensured in a particularly prefered manner by an arrangement which is characterized in that a footplate is arranged beneath the preferably front portion of the sole at such a level above the top surface of the ski and at such a distance from the toe unit, and/or is resiliently downwardly yielding to such a degree, that during forward inclination of the skier, for example in the case of a frontal fall, the parts of the sole which are in engagement with the sole clamp move downwardly to such an extent that the abutment on the sole clamp which follows the movement of the sole abuts, at least during a simultaneous sideways release movement of the sole clamp, against the inclined surfaces and thereby generates a counterforce to the sole clamp resetting force generated by the substantially forwardly directed spring force with the counterforce being dependent on the inclination of the inclined surface and of the spring bias of the sole clamp and being smaller than the sole clamp resetting force.

In accordance with a preferred embodiment the inclined surface is flat and extends transverse to the longitudinal direction of the ski.

The angle of the inclined surface may not be so steep that the projection slides downwardly without a lateral release movement on the inclined surface. Thus, the angle of the inclined surface to the horizontal should amount to between 30 to 60°, in particular to about 40 to 50° and preferably to approximately 45°. The angle is to be selected in dependence on the available force which is exerted downwardly on the sole clamp.

In a preferred embodiment the sole clamp has two individual halves which are each respectively acted on by the substantially forwardly directed spring force and which are outwardly pivotable independently from one another but are however connected together in form locked manner in the vertical direction such that the abutment can be provided on only one of the two halves. This embodiment has the advantage that during sideways release it is only the one half of the sole clamp which is loaded, the other is however force free.

With this arrangement the two front support positions for the sole of the ski boot should lie substantially behind the tilting axes. This prevents the thrust force exerted by the heel unit on the toe unit via the ski boot from exerting a lateral release moment on the sole clamp. Small defined spreading or closing forces can however be exerted by minor displacement of the support positions in the lateral direction relative to the tilting axes.

An advantageous arrangement for the generation of the forwardly directed spring force is characterized in that the substantially forwardly directed spring force is generated by a release spring arranged substantially in the longitudinal direction of the ski in front of the toe unit with the spring being supported at one end at the housing and acting at the other end optionally via a draw rod on a bolt which extends parallel to the tilting axes with the sole clamp or its halves being pivotally connected to the bolt. With this arrangement the bolt and the release spring, and optionally the draw rod, are advantageously located at the center between the tilting axes.

The bias of the sole clamp downwardly parallel to the tilting axes can be realized by a variety of arrangements. In one arrangement the resilient bias of the sole clamp downwardly is generated by a separate auxiliary spring. Alternatively the resilient bias of the sole clamp downwardly can be formed by the force component acting in the direction of the tilting axes of a release spring which extends obliquely forwardly and downwardly from the rear.

Another way of achieving the bias of the sole clamp downwardly is characterized in that the bias of the sole clamp downwardly is formed by the depression force exerted by the tip of the sole on a pedal provided on the sole clamp or on one of its halves.

The inclined surface is preferably mounted on the housing in the lower region of the sole clamp since in this manner an edge which is in any event present at the bottom and at the front on the sole clamp can be used as an abutment which cooperates with the inclined surface fixed relative to the housing.

A corresponding inclined surface with abutment can also be provided in the upper region of the toe unit of the invention. An arrangement of this kind is characterized in that an upwardly and forwardly facing abutment is provided on the sole clamp or on a part which is substantially vertically displaceable with the sole clamp and, in an analogous manner to the abutment mentioned previously, cooperates with an inclined downwardly and rearwardly facing surface on the housing when the front part of the sole of the ski boot displaces the sole clamp upwardly in a rear position of the skier, for example during a rearward fall, with the further abutment being moved upwardly against the further inclined surface until it abuts against it, whereupon a counterforce dependent on the inclination of the further inclined surface and on the upward force of the tip of the sole is produced to the sole clamp resetting force generated by the forwardly directed spring force, with the counterforce reducing the sideways release force and being preferably smaller than the sole clamp resetting force.

The constructional layout of this additional inclined surface and of the additional abutment can be effected analogously to the arrangement of claims 4 and 5. It is only the force required for the displacement of the sole clamp upwardly which is not generated by a spring but rather by the tip of the sole of the ski boot. In this way the friction force which occurs between the sole clamp and the tip of the sole can also be largely compensated for during a rearward fall.

The abutments and inclined surfaces can also be kinematically interchanged in the sense of an arrangement which is characterized in that at least one of the inclined surfaces is arranged on the sole clamp and the associated abutment is fixedly arranged relative to the housing.

An embodiment is also particularly preferred in which the tilting axes extend somewhat obliquely downwardly and forwardly from the top. This has the advantage that the sole clamp is also acted on with a downwardly directed force component by the thrust force which acts on the toe unit from the rear, with this downwardly directed force component pressing the sole clamp against the upper side of the tip of the sole and contributing to the downwardly acting bias force which is exerted in accordance with the invention on the sole clamp.

BRIEF DESCRIPTION OF THE DRAWINGS

The invention will now be described by way of example in the following with reference to the drawings in which are shown.

DETAILED DESCRIPTION OF THE PREFERRED EMBODIMENT

Figure 1A:
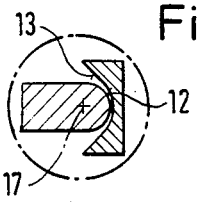
FIG. 1 a schematic plan view of a toe unit in accordance with the invention with an inserted ski boot, FIG. 1*a* the detail I*a* framed by a broken line in FIG.1 but to an enlarged scale, FIG. 2 a schematic side view of the article of FIG. 1, FIG. 3 a partially section side view of a practical embodiment of a toe unit, FIG. 4 a partly sectioned plan view of the article of FIG. 3, and FIG. 5 a partly sectioned side view of a further embodiment which is somewhat modified relative to FIG. 3.
Figure 1:
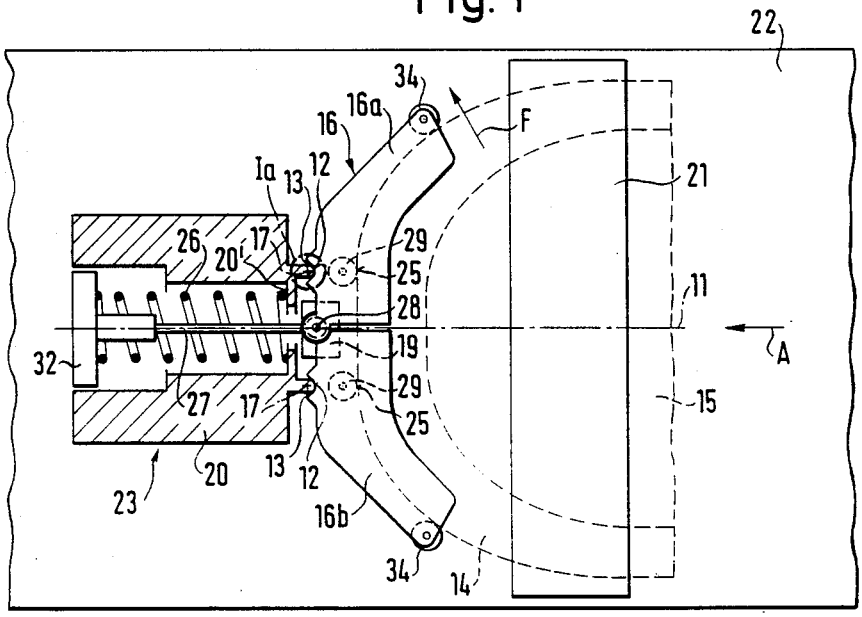
Figure 2:
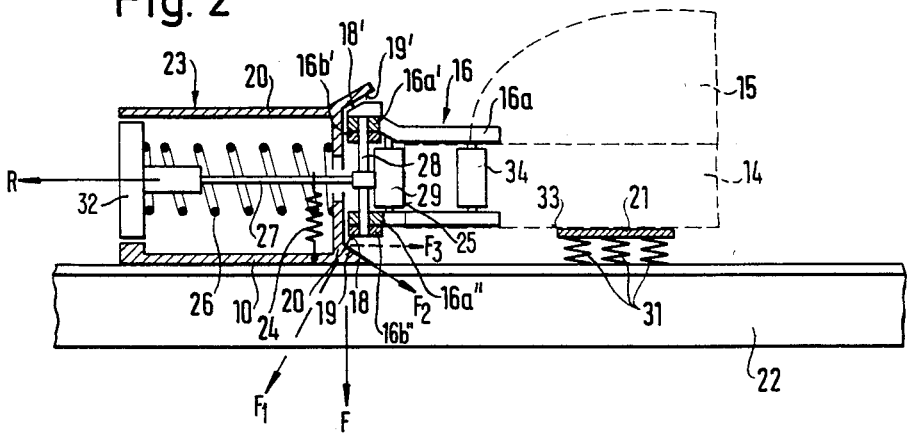

As seen in FIGS. 1 and 2 an elongate footplate 21 is provided on the upper side of a ski 22 below the front region of the sole 14 of the ski boot 15 with the elongate plate extending transversly to the top side of ski. The foot plate is secured to the top side of the ski 22 by a spring arrangement 31 in such a way that it can deflect downwardly during forward inclination of the skier as a result of the greater pressure exerted thereon by the sole 14 of the skier's boot, by an amount dependent on the pressure force exerted from above.

A toe unit 23 is arranged on the ski 22 in front of the footplate 21 and includes a sole clamp 16 consisting of two halves 16a, 16b and a housing 20 secured to the ski 22. The two halves 16a, 16b of the sole clamp 16 are symmetrically constructed relative to the vertical central longitudinal plane 11 of the toe unit 23 and indeed with the exception of the pivoting eyes 16a', 16a'' or 16b'', 16b'' which are vertically displaced, so they can be pivotally connected to one and the same pin or bolt 28 which is described further below.

As can be seen from FIGS. 1 and 1a the sole clamp halves 16a, 16b have front concave tilting surfaces 13 which are of relatively narrow construction and which extend vertically from the top to the bottom. Supporting surfaces 12 which are fixed relative to the housing and which are substantially complementary to the tilting surfaces engage in the latter. The tilting surfaces 13 are pressed forwardly against the support surfaces 12 by a release spring 26 which is braced at its rear end against an abutment 20' fixed relative to the housing and which acts with its other end via a spring biased adjustment screw 32 and a draw rod 27 on a vertically extending pin or bolt 28. The two sole clamp halves 16a and 16b are pivotally connected to the vertically extending pin 28 at the middle between the two support surfaces 12 by means of the pivot eyes 16a', 16b' and 16a'', 16b'', respectively.

If for example a lateral force F (FIG.1) now acts on the sole 14 of the ski boot 15, for example as a result of a rotating fall of the skier, then the right-hand half 16a of the sole clamp 16 pivots outwardly to the right and indeed about the vertical tilting axis 17 (FIG. 1, 1a). The left half 16b of the sole clamp 16 is thereby left force-free.

A vertically extending bias spring 24, which is for example arranged between the rear end region of the draw rod 27 and the base plate 10, and biases the sole clamp 16 downwardly in a manner which we discussed in more detail below.

In accordance with the invention a plane inclined surface 19 which extends obliquely rearwardly and downwardly from the top is located beneath the front end of the sole clamp 16 at the center between the two tilting axes 17 and cooperates with an abutment 18 formed by the lower front edge of the sole clamp 16.

The arrangement of the inclined surface 19 is such that with an inserted ski boot 15 (FIG. 2) and normal position of the skier without excessive forward position the abutment 18 does not exert any force from above onto the inclined surface 19, and is in particular arranged at a small distance from the inclined surface 19.

If the skier now moves into a forward position, for example during a frontal fall, then the force exerted downwardly by the front part of the sole 14 on the footplate 21 increases so that the footplate is displaced downwardly against the force of the spring arrangement 31. Furthermore, the sole of the ski boot can tilt downwardly somewhat during the downward movement about the front edge 33 of the foot plate 21. During this downward movement of the front part of the sole 14 the upper surface of the sole 14 which is in engagement with the sole clamp 16 also moves downwardly so that the sole clamp 16 can slide downwardly along the support surfaces 12 relative to the housing 20 under the action of the force of the bias spring 24 which is biasing it downwardly until the abutment 18 has contacted the inclined surface 19. As a result of suitable strength of the bias spring 24 and suitable inclination of the inclined surface 19 the movement of the sole clamp 16 downwardly can however not continue further from now on, and indeed not even when the upper surface of the sole 14 has not yet re-engaged with the lower surface of the sole clamp 16 which acts on it from above. As shown in FIG. 2, abutment 18 is in a lowered position, wherein it contacts inclined surface 19. In this position, spring 24 exerts a force F, downwardly from abutment 18 to surface 19, and a force B axially along the length of the spring. Force F may be resolved into a force component $F_1$ (which is perpendicular to surface 19) and a force component $F_2$ (which is parallel to surface 19). Force component $F_2$, in turn, has a force component $F_3$ which is directed opposite to the force R generated by spring 24 and which counter-acts force R. Thus, halves 16a, 16b of sole clamp 16 are pressed toward sole 14 with a correspondingly reduced force, as the invention is intended to act.

As a result of the inclination of the inclined surface 19 a rearwardly directed force component is now exerted by the bias 24 on the center of the sole clamp 16 on the inner pivot eye 16b' of the sole clamp half 16b with this force component being oppositely directed to the forwardly directed force exerted by the release spring 26, i.e. the force of the release spring 26 is counteracted.

If now, in such a case, the sole 14 of the ski boot is also loaded in the lateral direction, for example as a result of a combined frontal rotating fall then the force for the laterally outward pivotal movement of the relevant half 16a or 16b of the sole clamp 16 is correspondingly reduced. The friction between the footplate 21 and the sole 14 of the ski boot which is increased by the additional loading can in this way be extensively compensated for by a reduction of the lateral release force.

During the lateral release movement of the sole clamp 16 the abutment 18 slides downwardly on the inclined surface 19 until the sole clamp 16 again enters into engagement with the upper surface of the sole 14 of the ski boot. From this moment on the full lateral release force is again available so that the culmination point of the lateral release movement should now already be exceeded.

The substantially constant counterforce to the release force which is generated by the cooperation of the abutment 18 with the inclined surface 19 is thus effective for a period of time the further the tip of the sole has moved downwardly. An abutment 18' can also be provided at the top front end of the sole clamp 16 at the center between the tilting axes 17, with the abutment 18' cooperating in an analogous manner with an upper inclined surface 19' fixed relative to the housing.

When the skier moves out of the position of FIG. 2 into the rear position the tip of the sole 14 of the ski boot 15 presses the sole clamp upwardly against the force of the bias spring 24 until the abutment 18' comes into contact against the inclined surface 19'. From this moment on the lateral release force is correspondingly reduced with the strength of the reduction depending on the inclination of the inclined surface 19' and the force exerted upwardly on the sole clamp 16 by the tip of the sole.

Front support rollers 29 which are located in alignment with the tilting axes 17 are provided on the sole clamp 16, and lateral support rollers 34 for the edge of the sole 14 are provided at the rear end of the sole clamp halves 16a, 16b which extend obliquely outwardly. The support points 25 provided by the front rollers 29 are in alignment with the tilting axes 17 so that the thrust force A originating from a non-illustrated heel unit has no influence on the lateral release behaviour of the toe unit 16.

Figure 3:
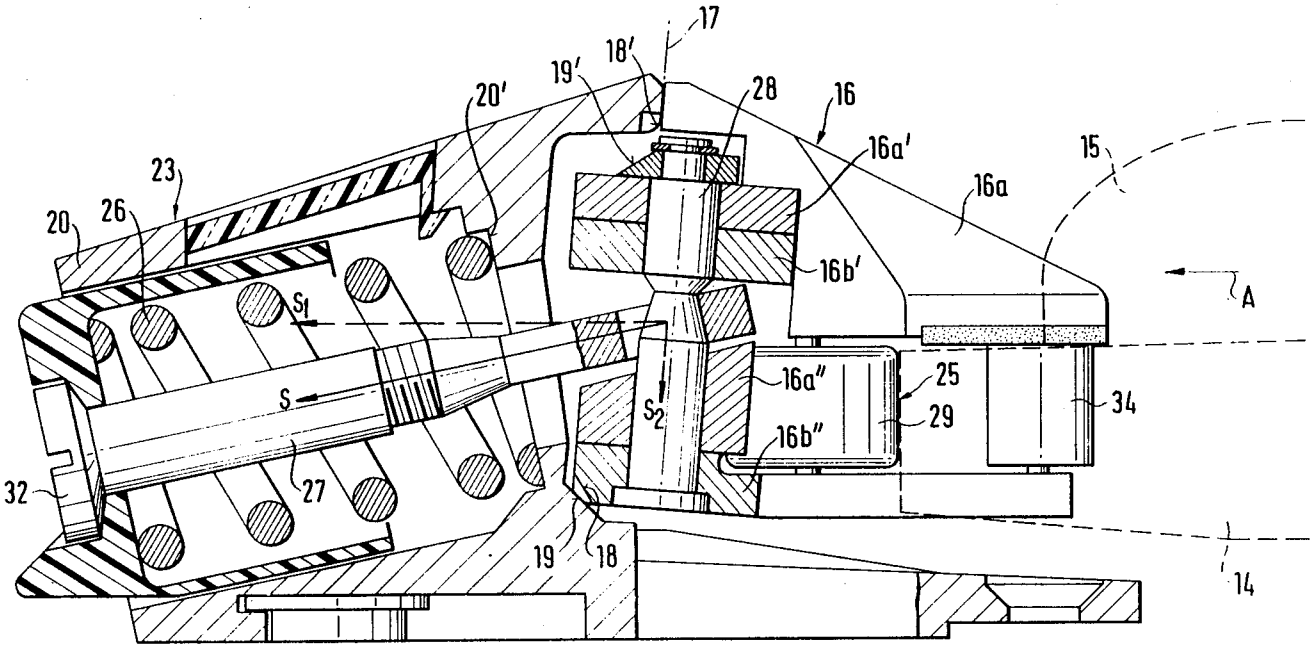

In FIGS. 3 and 4 the same reference numerals are used to designate corresponding components to those in FIGS. 1, 1*a* and 2.

In distinction to the embodiment of FIGS. 1 and 2 the force which presses the sole clamp 16 downwardly in the arrangement of FIGS. 3 and 4 is achieved by an oblique drop of the axis and thus of the force direction of the release spring 26, or of the draw rod 27, in a forward and downward direction. In this manner the force exerted by the release spring also has a component which extends downwardly in the direction of the tilting axes and which generates a part of the downward bias force for the sole clamp 16. As shown in FIG. 3, the force S of releasing spring 26 has a horizontal force component $S_1$ (which corresponds to force R in FIG. 2) a vertical force component $S_2$ (which corresponds to force F in FIG. 2).

Moreover the tilting axes 17 are tilted somewhat relative to the vertical in the embodiment of FIGS. 3 and 4 in such a way that they extend downwardly and somewhat forwardly from the top. In this manner the thrust force A originating from the heal unit also generates a part of the bias force which acts downwardly towards the inclined surface 19.

FIG. 3 illustrates the case in which the sole clamp 16 has already slid somewhat downwardly due to a forward position of the skier, with the abutment 18 already engaging with the inclined surface 19 and with the lateral release force already being correspondingly reduced.

In the upper region of the toe unit 23 the inclined surface 19' and the abutment 18' are shown kinematically inverted relative to the embodiment of FIGS. 1 and 2 in the sense that the abutment 18' is fixed relative to the housing and the inclined surface 19' is provided in the upper region of the sole clamp 16.

In the embodiment of FIG. 5 a pedal abutment 30 is provided at the lower end of the sole clamp or of one or both of its halves 16*a*, 16*b* with the pedal abutment engaging with the lower side of the tip of the sole 14. During downward movement of the sole 14 in the event of a frontal fall a downwardly directed force is thus exerted on the sole clamp 16 by the sole 14 itself via the pedal abutment 30 which leads to a further reduction of the lateral relase force via the inclined surface 19.

Thus various parameters and constructional means are available either alone or in combination for providing a desired friction compensation namely the force of the release spring 26 itself, the force of a special auxiliary spring 24, the boot pressure force upwardly or downwardly, the thrust force from the heel unit and also the abutments and inclined surfaces in various arrangements and constructions.

I claim:

1. Toe unit of a safety ski binding, for use with a ski boot and a ski, the ski having a front and rear portion and a top surface, , the toe unit comprising a housing, secured to the ski, including an inclined surface (19) fixed relative to the housing, and including two substantially vertical axes of rotation disposed on both sides of a vertical central longitudinal plane of the housing; a sole clamp which supports a front part of a sole of the ski boot from the front of, the sides of and from above the ski boot sole when the ski boot is attached to the ski binding; a spring (26) acting between the housing and the sole clamp for generating a substantially forwardly directed spring force; the sole clamp being pivotable against the substantially forwardly directed spring force about a respective one of said two substantially vertical axes of rotation such that on an occurrence of predetermined lateral forces at the front part of the sole, the sole clamp pivots outwardly about one of said axes of rotation lying in a direction of such lateral force and releases the ski boot, with the sole clamp being displaceable relative to the housing in a direction of the axes of rotation and being resiliently biased in this direction towards the front part of the sole of the ski boot, wherein the sole clamp further includes a downwardly and forwardly facing abutment (18) in a chosen one of a region between the axes of rotation (17) and on a part movable with the sole clamp along the axes of rotation (17) and cooperates with said inclined surface (19), extending downwardly and rearwardly in such a way that when the ski boot (15) is inserted into the binding, the ski boot sole (14) holds the sole clamp (16) against a downwardly directed spring bias at a level at which the abutment (18) is located at at least a small distance from the inclined surface (19) so as to exert no forces on the inclined surface (19); and wherein the ski boot (15) is downwardly yieldingly supported on the ski (22) in such a way that with forward inclination of a skier using the binding, at least a portion of the sole (14) engaging the sole clamp (16) moves downwardly such that the abutment (18) on the sole clamp (16), which follows the movement of the sole (14), abuts on the inclined surface (19) at least during a simultaneous sideways release movement of the sole clamp (16), to generate a counterforce to a sole clamp resetting force generated by the substantially forwardly directed spring force, the counterforce being dependent on an inclination of the inclined surface (19) and the resilient bias of the sole clamp (16) in the downward direction, and being smaller than the sole clamp resetting force.

2. Toe unit according to claim 1, further including a spring (26), wherein the sole clamp has two linear and substantially vertically extending tilting surfaces (13) provided on both sides of the vertical central longitudinal plane which are pressed by the substantially forwardly directed spring force (26) against support surfaces (12) provided on the housing parallel to the tilting surfaces (13) on both sides of the vertical central longitudinal plane, such that two tilting axes forming the axes of rotation (17) are formed for the sole clamp, (16).

3. Toe unit according to claim 1, further including a footplate (21), disposed beneath a front portion of the sole (14) at such a level above a top surface of the ski (22) and at such a distance from the toe unit (23), and being resiliently downwardly yielding to such a degree that during forward inclination of a skier using the toe unit, portions of the sole (14) which are in engagement with the sole clamp (16) move downwardly to such an extent that the abutment (18) on the sole clamp (16) which follows the movement of the sole (14) abuts, at least during a simultaneous sideways release movement of the sole clamp (16), against the inclined surface (19), such that a counterforce to the sole clamp resetting force is generated by the substantially forwardly directed spring force, wherein the counterforce is dependent on the inclination of the inclined surface (19) and of a spring bias of the sole clamp (16) and is smaller than a sole clamp resetting force.

4. Toe unit according to claim 1, wherein the inclined surface (19) is planar.

5. Toe unit according to claim 1, wherein the angle of the inclined surface (19) to the horizontal is about 30° to about 60°.

6. Toe unit according to claim 1, wherein the sole clamp (16) has two individual halves (16*a*, 16*b*) which are outwardly pivotable independently from each other but are lockingly interconnected in a vertical direction such that the abutment (18) is provided at a chosen one of the two individual halves, each half being respectively acted on by the substantially forwardly directed spring force.

7. Toe unit according to claim 1, wherein the sole clamp (16) includes two front supports (25) for the sole (14) of the ski boot (15), which supports lie substantially behind the tilting axes (17).

8. Toe unit according to claim 1, wherein said spring is a release spring arranged longitudinal direction of the ski in front of the toe unit (23), the spring being supported at one end at the housing and acting at the other end on a bolt (28) which extends parallel to the tilting axes (17) and is pivotally connected with the sole claim (16).

9. Toe unit according to claim 8, wherein the bolt 28 and the release spring (26) are located at a position midway between the tilting axes.

10. Toe unit according to claim 1, further including an auxiliary spring (24) for generating the resilient bias of the sole clamp (16) in the downward direction.

11. Toe unit according to claim 1, further including a release spring (26) extending obliquely forwardly and downwardly relative to the ski boot, wherein the resilient bias of the sole clamp (16) in a downward direction is formed by a force component pointing in the direction of the tilting axes (17) of the release spring (26).

12. Toe unit according to claim 1, wherein the inclined surface (19) is attached to the housing (20) in a lower region of the sole claim (16).

13. Toe unit according to claim 1, wherein the abutment (18) is fixedly arranged relative to the housing.

14. Toe unit according to claim 1, wherein the tilting axes (17) extend somewhat obliquely downwardly and forwardly from the top.

* * * * *